United States Patent [19]

Brehm

[11] 4,111,368

[45] Sep. 5, 1978

[54] DISPENSING APPARATUS

[75] Inventor: William L. Brehm, Plumsteadville, Pa.

[73] Assignee: B & G Equipment Company, Plumsteadville, Pa.

[21] Appl. No.: 770,822

[22] Filed: Feb. 22, 1977

Related U.S. Application Data

[63] Continuation-in-part of Ser. No. 734,181, Oct. 20, 1976, abandoned, which is a continuation of Ser. No. 603,737, Aug. 11, 1975, abandoned.

[51] Int. Cl.[2] ..... B05B 1/16

[52] U.S. Cl. ..... 239/394; 239/600

[58] Field of Search ..... 239/390, 391, 392, 394, 239/397, 589, 600

[56] References Cited

U.S. PATENT DOCUMENTS

| | | | |
|---|---|---|---|
| 191,199 | 5/1877 | Tomlinson | 239/394 |
| 580,142 | 4/1897 | Nielsen et al. | 239/394 |
| 1,516,078 | 11/1924 | Bucknam | 239/588 X |
| 1,981,077 | 11/1934 | Shields | 239/528 X |
| 2,697,485 | 12/1954 | McNally | 239/394 X |
| 2,968,441 | 1/1961 | Holcomb | 239/337 |
| 3,377,028 | 4/1968 | Bruggeman | 239/394 |
| 3,516,611 | 6/1970 | Piggott | 239/394 X |
| 3,711,029 | 1/1973 | Bartlett | 239/394 |

FOREIGN PATENT DOCUMENTS

| | | | |
|---|---|---|---|
| 102,923 | 1/1924 | Switzerland | 239/394 |
| 627,906 | 8/1949 | United Kingdom | 239/394 |

*Primary Examiner*—Johnny D. Cherry

*Attorney, Agent, or Firm*—Zachary T. Wobensmith, 2nd; Zachary T. Wobensmith, III

[57] ABSTRACT

Dispensing apparatus is provided suitable for application of residual insecticides in a liquid carrier with which the fluid may be dispensed in spray form or delivered into cracks and crevices through an elongated tip extension of flexible plastic tubing and movable into, or out of operating position, the elongated tip extension being readily removable and insertable as desired.

5 Claims, 6 Drawing Figures

FIG. 1
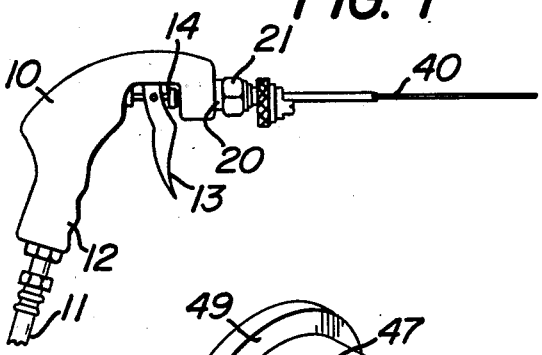
FIG. 3
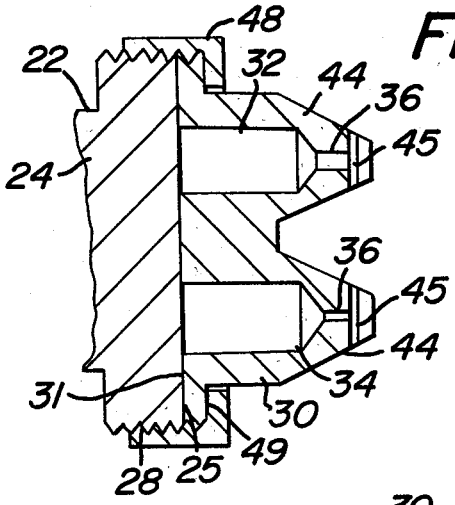
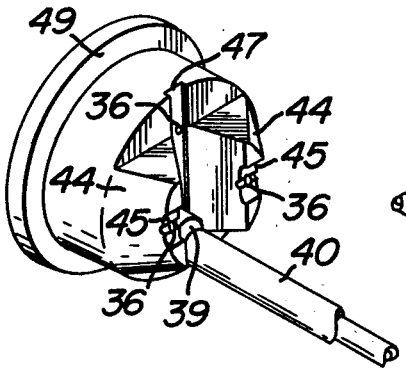
FIG. 4
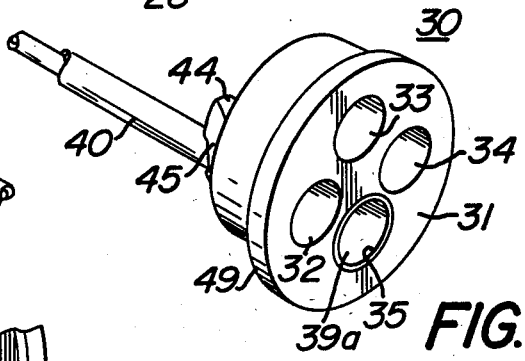
FIG. 5
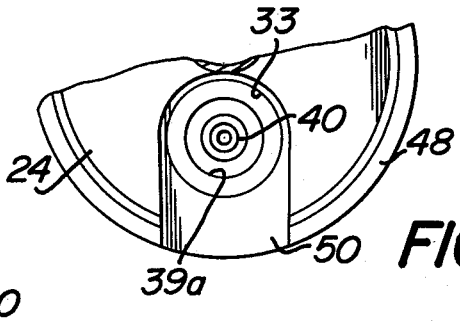
FIG. 6
FIG. 2
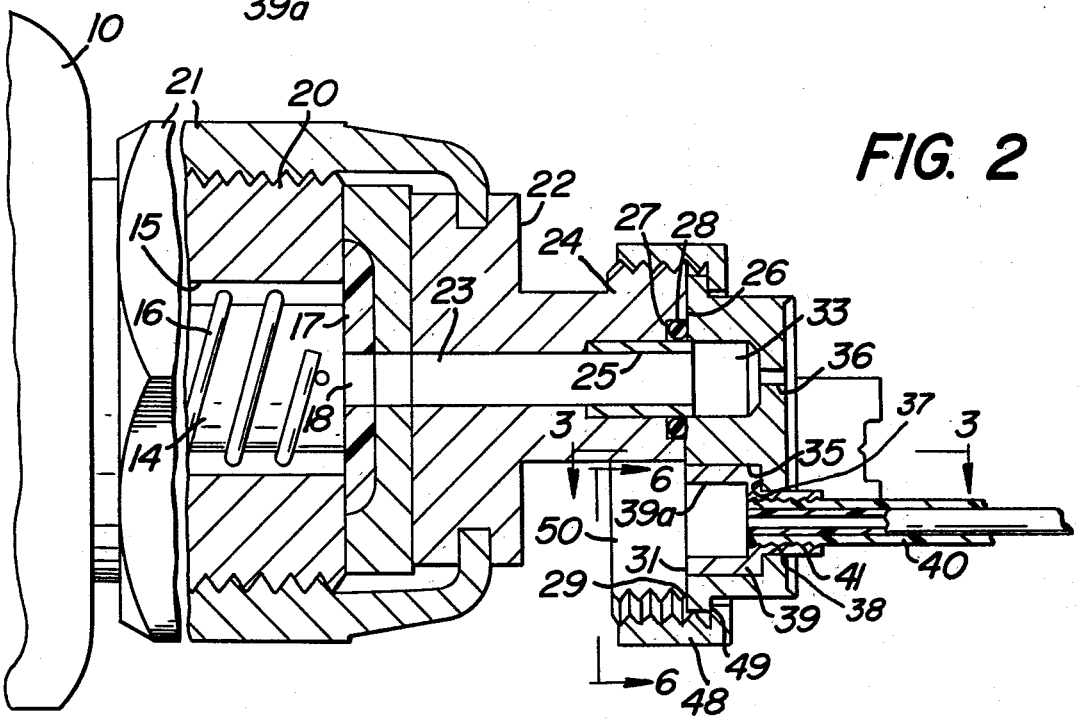

DISPENSING APPARATUS

CROSS REFERENCE TO RELATED APPLICATIONS

This application is a continuation in part of my prior application for Dispensing Apparatus, filed Oct. 20, 1976, Ser. No. 734,181, now abandoned, which is a continuation of my prior application filed Aug. 11, 1975, Ser. No. 603,737, now abandoned.

BACKGROUND OF THE INVENTION

1. Field of the Invention

This invention relates to dispensing apparatus for insecticides for selective delivery of spray or of liquid through an elongated tip extension for applicaton of insecticides to cracks and crevices.

2. Description of the Prior Art

It has heretofore been proposed to deliver insecticides in spray form, using a portable pressurized tank connected by flexible tubing to a hand controlled trigger on which a spray nozzle is carried.

Selectivity of spray nozzles is shown in the U.S. Pats. to Bruggeman, No. 3,377,028; McNally, No. 2,697,485; Bartlett, No. 3,711,029.

Structure providing selectivity as between a straight stream of liquid or a spray is shown in the U.S. Pat. to Tomlinson, No. 191,199 and the British Pat. to Dietrich, No. 627,906.

Bucknam, U.S. Pat. No. 1,516,078; Holcomb, U.S. Pat. No. 2,968,441 and Price, U.S. Pat. No. 2,804,344 show elongated tubular extensions for liquid delivery but no selectivity as to liquid or spray delivery.

None of the structures heretofore available permitted of selective use of a spray forming orifice or a liquid delivery flexible tube for cracks and crevices with provision for ready removal and insertion of the liquid delivery flexible tube.

SUMMARY OF THE INVENTION

In accordance with the invention apparatus is provided suited for use with presently available equipment for selective delivery of liquid or spray material such as a residual insecticide, as desired, and in which an elongated flexible liquid delivery tube can be readily removed from or inserted into the apparatus as desired.

It is the principal object of the invention to provide dispensing apparatus having a tip construction which can be readily used with available equipment and which includes an elongated flexible tube to facilitate delivery of insecticide to hard to reach and relatively inaccessible areas, the flexible tube being readily removable and reinsertable, as desired.

It is a further object of the invention to provide in dispensing apparatus of the character aforesaid an elongated flexible tube which is a non-conductor of electricity so as to avoid electrical shock in use.

It is a further object of the invention to provide dispensing apparatus which is simple in construction and free from the likelihood of operating difficulties.

Other objects and advantageous features will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 1 is a view in elevation of the dispensing apparatus of the invention mounted on a pistol grip hand trigger operated control valve;

FIG. 2 is an enlarged vertical longitudinal central sectional view of the dispensing apparatus with the flexible tube in position for removal;

FIG. 3 is a fragmentary longitudinal sectional view taken approximately on the line 3—3 of FIG. 2;

FIG. 4 is a view in perspective of the tip extension and its mounting as seen from the front;

FIG. 5 is a view similar to FIG. 4 as seen from the rear; and

FIG. 6 is a fragmentary sectional view taken at the line 6—6 of FIG. 2.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings a pistol grip hand trigger operated control valve is shown at 10, connected by a flexible pipe 11 to a pressurized source of the insecticide or the like to be dispensed, and which may be a back carried or other portable tank.

The control valve 10 is shown as having a hand grip portion 12 and a pivotally mounted finger operated trigger 13 which controls a valve rod 14 in a bore 15 and normally urged to shut-off position by spring 16 in engagement with an annnular disc seat 17 having a passageway 18 therethrough.

The valve 10 on the front thereof has a threaded mounting portion 20 for the reception of an internally threaded attaching nut 21, the nut 21 having a dispensing connector fitting 22 carried thereby. The connector fitting 22 has a fluid passageway 23 communicating with the bore 15. The connector fitting has a connector plate 24 carried thereby offset or eccentric with respect to the nut 21.

A tubular insert 25 is preferably provided in the passageway 23, extends outwardly beyond the front face 26 of the connector plate 24 and is surrounded by a groove 27 in which a packing ring 28 is mounted.

The connector plate 24 is also eccentric with respect to the passageway 23 and has a threaded periphery 29.

An orifice and tip carrying extension fitting 30 is provided having a rear face 31 for engagement with the face 26.

The fitting 30 has a plurality of bores 32, 33, 34 and 35 extending forwardly from the face 31. The bores 32, 33 and 34 have internal diameters for selective reception on the end of the tubular insert 25 for orientation and for sealing at their peripheries by the packing ring 28. The bores 32, 33 and 34 are shown as provided with orifices 36 which can be of different predetermined sizes for atomization of liquid delivered thereto for spraying.

The bore 35 of the fitting 30 has a shoulder 37 formed thereon and a smaller forward bore 38 for the reception of a complemental tube holder 39. The tube holder 39 has an internal bore **39*a* for reception on the end of the tubular insert 25. The tube holder 39 carries an elongated flexible tube 40, preferably of synthetic plastic and non-electrical conducting, for liquid delivery. The tube 40 can be retained in any desired manner such as by engagement with internal threads 41**.

The front face of the fitting 30 is preferably provided with spaced projections 44 to facilitate turning for selective positioning of the bores 32, 33 34 or 39*a* on the tubular insert 25.

The forward ends of the projections 44 can be grooved as at 45 to facilitate atomization at the orifices 36 and a groove 47 can also be provided for the same purpose.

In order to hold the fitting 30 at the desired orientation, for atomization at a selected orifice 36 or for liquid delivery through the tube 40, an internally threaded collar 48 is provided for engagement on the threaded periphery 29 and with the fitting 30 at the rim shoulder 49. It is desired for some types of spraying operations that tube holder 39 and tube 40 be removable and replaceable as desired. For this purpose a slot 50 is provided in the connector plate 24, extending inwardly from the threaded periphery 29 and with adequate clearance for the tube holder 39.

The mode of use will be apparent from the foregoing.

With the fitting 30 turned to the desired position for atomization at a selected orifice 36 or for delivery of liquid through the flexible tube 40 liquid is delivered from the source as controlled by the manipulation of the trigger 13, the fitting 30 being oriented and positioned by engagement of one of the bores 32, 33, 34 or 39*a* on the tubular insert 25 and held in position by the nut 48.

For change of spray the nut 48 is loosened to the extent that the fitting 30 can be moved from engagement of a bore on the tubular insert 25, the fitting 30 turned to the desired position and the nut 48 tightened.

If it is desired to remove the tube holder 39 and the tube 40, the nut 48 is loosened and the fitting 30 is turned to bring the tube holder 39 in meeting relation to the slot 50. The tube holder 39 and tube 40 can be moved to the left as can be seen in FIG. 2 into the slot 50 and then downwardly therebeyond.

The tube 40 and tube holder 39 can be reinserted through the slot 50 by a reverse operation and after reinsertion, upon loosening of the nut 48, can be moved if desired to a position for liquid dispensing and the nut 48 tightened.

I claim:

1. Dispensing apparatus for attachment to a hand operated control valve for selective delivery of liquid or spray which comprises a connector plate member carried by said valve and having a fluid passageway, a dispensing member mounted for selective positioning with respect to said fluid passageway, a clamping member in detachable engagement with said dispensing member and retaining said dispensing member at a selected position, said dispensing member having a plurality of openings for selective alignment with said fluid passageway, said dispensing member having one of said openings provided with an atomizing orifice for spray delivery under the control of said valve member, said dispensing member having in another of said openings a detachable tube holder with an opening for alignment with said fluid passageway for liquid delivery, an elongated flexible tube carried by said tube holder for liquid delivery under the control of said valve member, and said connector plate member having a portion for removal of said tube holder and tube.

2. Dispensing apparatus as defined in claim 1 in which a positive positioning member is provided for said dispensing member.

3. Dispensing apparatus as defined in claim 2 in which said positioning member is a tubular extension from said connector plate member for engagement in one of said openings.

4. Dispensing apparatus as defined in claim 1 in which said last mentioned portion is a slot accessible for tube holder and tube removal in one position of said dispensing member.

5. Dispensing apparatus as defined in claim 1 in which said last mentioned portion is a slot for tube holder and tube removal upon loosening of said clamping member and positioning of said tube holder in alignment with said slot.

* * * * *